US010788205B2

(12) United States Patent
Hsu

(10) Patent No.: US 10,788,205 B2
(45) Date of Patent: Sep. 29, 2020

(54) ATOMIZING SYSTEM

(71) Applicant: ASIA IC MIC-PROCESS, INC., Hsinchu (TW)

(72) Inventor: Hung-Hsin Hsu, Hsinchu County (TW)

(73) Assignee: ASIA IC MIC-PROCESS, INC., Hsinchu (TW)

( * ) Notice: Subject to any disclaimer, the term of this patent is extended or adjusted under 35 U.S.C. 154(b) by 209 days.

(21) Appl. No.: 16/026,787

(22) Filed: Jul. 3, 2018

(65) Prior Publication Data

US 2019/0003703 A1 Jan. 3, 2019

Related U.S. Application Data

(60) Provisional application No. 62/528,311, filed on Jul. 3, 2017.

(51) Int. Cl.

| | |
|---|---|
| ***B01F 3/04*** | (2006.01) |
| ***F22G 3/00*** | (2006.01) |
| ***B01F 5/04*** | (2006.01) |
| ***B05B 12/00*** | (2018.01) |
| *B01F 5/00* | (2006.01) |
| *B05B 7/26* | (2006.01) |
| *B05B 7/00* | (2006.01) |

(52) U.S. Cl.

CPC ..... *F22G 3/001* (2013.01); *B01F 3/04056* (2013.01); *B01F 5/0475* (2013.01); *B01F 5/0486* (2013.01); *B05B 12/004* (2013.01); *F22G 3/007* (2013.01); *B01F 2005/0005* (2013.01); *B05B 7/0012* (2013.01); *B05B 7/262* (2013.01)

(58) Field of Classification Search

CPC .. B01F 3/04056; B01F 5/0475; B01F 5/0486; B01F 2005/0005; B05B 7/0012; B05B 7/262; B05B 12/004; F22G 3/001; F22G 3/007

USPC ..... 261/76, 78.2, 117, 118

See application file for complete search history.

(56) References Cited

U.S. PATENT DOCUMENTS

| | | | | |
|---|---|---|---|---|
| 2,675,214 A * | 4/1954 | Wendell, Jr. | B01F 3/04007 | 261/21 |
| 3,682,167 A * | 8/1972 | Urbanowica | A61M 11/06 | 128/200.14 |
| 3,834,133 A * | 9/1974 | Bow | B01D 1/16 | 96/181 |
| 3,860,173 A * | 1/1975 | Sata | B05B 17/0623 | 239/102.2 |
| 3,945,804 A * | 3/1976 | Shang | B01J 10/005 | 422/127 |

(Continued)

*Primary Examiner* — Charles S Bushey

(57) ABSTRACT

An atomizing system is provided to connect a liquid supply zone and a gas supply zone. In the atomizing system, a first pipeline is connected between the liquid supply zone and a first treatment tank, a second pipeline is connected between the first treatment tank and a second treatment tank, a third pipeline is connected between the gas supply zone and the second treatment tank. The end of each of the nozzles is connected to the other end of the third pipeline. The liquid supplied from the liquid supply zone is flowed into the second treatment tank through the second pipeline, the gas supplied from the gas supply zone is flowed into the second treatment tank through the nozzles, so that the liquid contacts the gas in the second treatment tank to produce the atomized liquid.

8 Claims, 4 Drawing Sheets

(56) References Cited

U.S. PATENT DOCUMENTS

| | | | | | |
|---|---|---|---|---|---|
| 4,548,621 | A * | 10/1985 | Eriksson | C22B 19/00 | 75/666 |
| 4,767,498 | A * | 8/1988 | Kreisler | B01D 1/16 | 159/16.1 |
| 5,809,981 | A * | 9/1998 | Berg-Sonne | F01P 9/02 | 123/563 |
| 8,864,111 | B2 * | 10/2014 | Wong | F24F 6/12 | 261/142 |

* cited by examiner

ATOMIZING SYSTEM

CROSS-REFERENCE TO RELATED APPLICATION

This application claims priority to U.S. Provisional Application Ser. No. 62/528,311, filed on Jul. 3, 2017, the content of which is hereby incorporated by reference in their entirety for all purposes.

BACKGROUND OF THE INVENTION

1. Field of the Invention

The present invention generally relates to an atomizer device, more particularly to an atomizing system including an atomizer device connected to a liquid supply zone and a gas supply zone. The atomizer device produces an atomized liquid, and the delivery device connected to the atomizer device can guide the atomized liquid to flow into the atomized liquid application apparatus, so that the atomized liquid application apparatus can maintain humidity within a set range.

2. Description of the Related Art

In recent years, the atomizing device, which combines high-pressure gas and liquid to produce an atomized liquid, generally directly guides the high-pressure gas to flow into to a space in which the liquid is stored. The atomized liquid is then guided to flow into the atomized liquid application apparatus through a conveyer pipe connected to the atomizer device.

However, when the atomized liquid condenses on the pipe wall of the conveyer pipe to form a liquid, the liquid may also be guided by the high-pressure gas to flow into the atomized liquid application apparatus. This process can affect the contents of the atomized liquid application apparatus. Furthermore, liquid condensation on the pipe wall may reflow into the atomizer device, affecting the stability of the atomization process.

In consideration of the above problems, the inventor of the present invention has improved a conventional atomizing device, which is unable to maintain the stability of the atomization process effectively. In this way, the atomized liquid is properly treated in the conveyer pipe solving the conventional problems.

SUMMARY OF THE INVENTION

In order to solve the conventional problems, the present invention has provided an atomizing system, in which liquid is supplied from the liquid supply zone to a first treatment tank. The liquid can then flow into the second treatment tank through a pipeline in communication with the first treatment tank and the second treatment tank, to contact the gas flowing into the second treatment tank from the gas supply zone, so as to produce the atomized liquid. From there, the atomized liquid can be guided, subject to the pressure of the gas supply zone, to flow into the delivery device connected to a top of the second treatment tank. The delivery device can guide the atomized liquid to flow into the atomized liquid application apparatus, and the liquid condensed on the pipe wall of the conveyer pipe can reflow into the first treatment tank through the delivery device.

According to an embodiment, the present invention provides an atomizing system connected to a liquid supply zone and a gas supply zone comprising eight parts. A first pipeline comprising an end connected to the liquid supply zone. A first treatment tank connected to other end of the first pipeline. A second pipeline comprising an end connected to a bottom end of the first treatment tank. A second treatment tank comprising a bottom end connected to other end of the second pipeline. A third pipeline comprising an end connected to the gas supply zone, and the other end inserted through the second treatment tank. A plurality of nozzles, wherein each of the plurality of nozzles comprises an end connected to the other end of the third pipeline. A liquid flow pipeline disposed inside the first treatment tank, and comprising an end connected to the other end of the first pipeline. A water level sensor disposed inside the first treatment tank, comprising an end connected to the bottom end of the first treatment tank. The liquid supplied from the liquid supply zone is flowed into the second treatment tank through the second pipeline, gas supplied from the gas supply zone is flowed into the second treatment tank through the nozzle, and the liquid contacts the gas in the second treatment tank to produce an atomized liquid.

The atomizing system further comprises a delivery device comprising a first elbow pipe, a conveyer pipe group, a first pipe tee, a first connecting pipe, a second elbow pipe, a pipe cap, a second connecting pipe, and a third elbow pipe. An end of the first elbow pipe is connected to a top of the second treatment tank. An end of the conveyer pipe group is connected to other end of the first elbow pipe. A first open end of the first pipe tee is connected to other end of the conveyer pipe group. A second open end of the first pipe tee is connected to an end of the first connecting pipe. The pipe cap is connected to other end of the first connecting pipe. An end of the second elbow pipe is connected to a third open end of the first pipe tee. An end of the second connecting pipe is connected to other end of the second elbow pipe. An end of the third elbow pipe is connected to other end of the second connecting pipe. The other end of the third elbow pipe is connected to the top of the first treatment tank.

The conveyer pipe group comprises a plurality of third connecting pipes and a plurality of second pipe tees, one of the plurality of third connecting pipes is disposed in an end of the conveyer pipe group. The other of the plurality of third connecting pipes is disposed in other end of the conveyer pipe group. A fourth open end and a fifth open end of any one of the plurality of second pipe tees are connected to the third connecting pipe, respectively. A sixth open end of any one of the plurality of second pipe tees is connected to an end of a fourth connecting pipe, and the other ends of the plurality of fourth connecting pipes are connected to ends of a plurality of atomized liquid application apparatuses.

The atomizing system further comprises a discharge pipe, an overflow pipe, and a liquid collection bucket. An end of the discharge pipe is connected to the top of the first treatment tank, an end of the overflow pipe is inserted through the bottom end of the first treatment tank, and the liquid collection bucket is connected to other end of the overflow pipe.

The first treatment tank comprises a first liquid zone and a first atomized liquid zone, and the second treatment tank comprises a second liquid zone and a second atomized liquid zone. The first liquid zone is disposed adjacent to the bottom end of the first treatment tank; the first atomized liquid zone is disposed adjacent to the top of the first treatment tank. The second liquid zone is disposed adjacent to the bottom end of the second treatment tank, and the second atomized liquid zone is disposed adjacent to the top of the second treatment tank.

The liquid supply zone is in communication with the end of the first pipeline, the other end of the first pipeline is in communication with the end of the liquid flow pipeline. The end of the liquid flow pipeline is in communication with the first liquid zone, the first liquid zone is in communication with the end of the second pipeline and the end of the overflow pipe. The other end of the overflow pipe is in communication with the liquid collection bucket. The other end of the second pipeline is in communication with the second liquid zone. The gas supply zone is communication with the end of the third pipeline. The other end of the third pipeline is in communication with the ends of the plurality of nozzles. The other ends of the plurality of nozzles are in communication with the second atomized liquid zone. The second atomized liquid zone is in communication with the delivery device. The delivery device is in communication with the plurality of atomized liquid application apparatuses and the first atomized liquid zone. The first atomized liquid zone is in communication with the end of the discharge pipe.

Each of the plurality of atomized liquid application apparatuses comprises a humidity sensor configured to sense humidity in an interior space thereof and display a humidity message.

The humidity message comprises a text, a pattern, a light or a combination thereof.

According to above-mentioned content, the atomizing system of the present invention has the following advantages.

First, compared with a conventional atomizer device, in the atomizing system of the present invention the atomized liquid produced in the second atomized liquid zone in the second treatment tank can be guided, subject to the pressure of the gas supply zone, to flow into the delivery device. The liquid condensed on the pipe wall of the delivery device can efficiently flow into the liquid zone of the first treatment tank through the pipes of the delivery device, so as to prevent the liquid from entering the atomized liquid application apparatus to affect the content inside. The excessive atomized liquid can be guided to flow into the first atomized liquid zone of the first treatment tank.

Second, when excessive atomized liquid or the liquid is guided to flow into the first treatment tank through the delivery device, the excessive atomized liquid can be discharged from the first treatment tank through the discharge pipe of the first treatment tank. This allows the operation of flowing liquid into the first treatment tank to not be affected; and, when excessive liquid reflows into the liquid zone of the first treatment tank to cause excessively-high water level, the excessive liquid can be guided to flow into the liquid collection bucket through overflow pipe. As a result, the atomizing process of producing atomized liquid in the second treatment tank is not affected by the atomized liquid or the liquid reflowing from the delivery device, thereby maintaining stability of the atomizing process.

BRIEF DESCRIPTION OF THE DRAWINGS

The structure, operating principle and effects of the present invention will be described in detail by way of various embodiments, which are illustrated in the accompanying drawings.

DETAILED DESCRIPTION OF THE PREFERRED EMBODIMENTS

Figure 1:
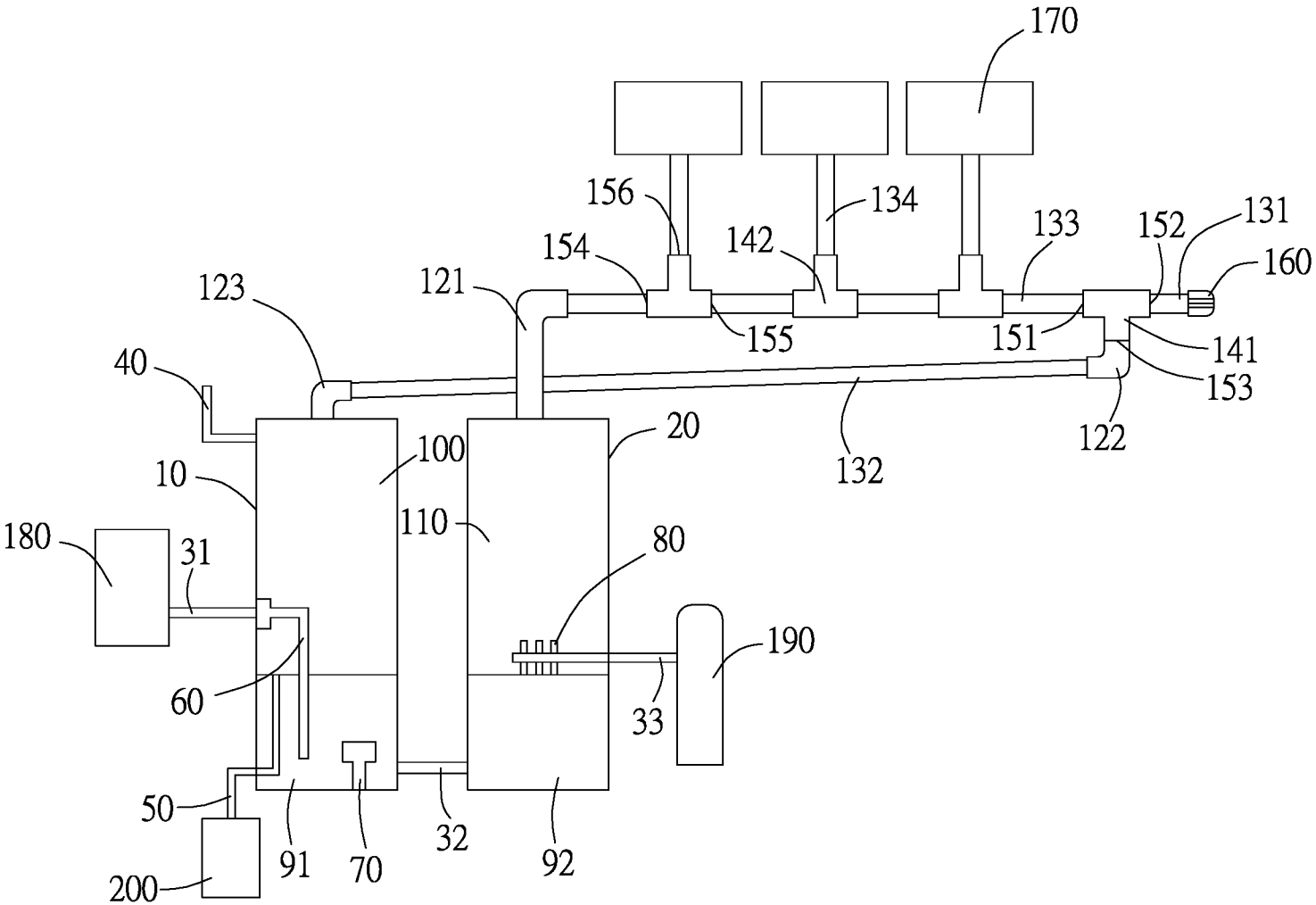
FIG. 1 is a schematic view of configuration of components of an atomizing system of an embodiment of the present invention.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising" will be understood to imply the inclusion of stated elements but not the exclusion of any other elements.

It should be noted that, in the description of the present invention, the terms "link", "insert", "in communication with", "conduct", "set", "accommodate", "guide" should be broadly understood unless specifically stated otherwise.

Please refer to FIG. 1, which is a schematic view of configuration of components of an atomizing system of an embodiment of the present invention. As shown in FIG. 1, the atomizing system comprises a first pipeline 31, a first treatment tank 10, a second pipeline 32, a second treatment tank 20, a third pipeline 33, a plurality of nozzles 80, a liquid flow pipeline 60 and a water level sensor 70. The end of the first pipeline 31 is connected to the liquid supply zone 180, and the first treatment tank 10 is connected to other end of the first pipeline 31. The end of the second pipeline 32 is connected to the bottom end of the first treatment tank 10, and a bottom end of second treatment tank 20 is connected to the other end of the second pipeline 32. The third pipeline 33 comprises an end connected to the gas supply zone 190, and other end inserted through the second treatment tank 20. An end of the nozzle 80 is connected to other end of the third pipeline 33. The liquid flow pipeline 60 is disposed inside the first treatment tank 10, and an end of the liquid flow pipeline 60 is connected to other end of the first pipeline 31. The water level sensor 70 is disposed inside the first treatment tank 10, and an end of the water level sensor 70 is connected to a bottom end of the first treatment tank 10.

The liquid supplied from the liquid supply zone 180 can be guided to flow into the second treatment tank 20 through the second pipeline 32. The gas supplied from the gas supply zone 190 can be guided to flow into the second treatment tank 20 through the nozzle 80, so that the liquid can contact the gas in the second treatment tank 20 to produce the atomized liquid.

In an embodiment, the atomizing system comprises a delivery device comprising a first elbow pipe 121, a conveyer pipe group, a first pipe tee 141, a first connecting pipe 131, a second elbow pipe 122, a pipe cap 160, a second connecting pipe 132 and a third elbow pipe 123. An end of the first elbow pipe 121 is connected to the top of the second treatment tank 20. The end of the conveyer pipe group is connected to other end of the first elbow pipe 121. The first open end 151 of the first pipe tee 141 is connected to the other end of the conveyer pipe group. The second open end 152 of the first pipe tee 141 is connected to an end of the first connecting pipe 131. The pipe cap 160 is connected to other end of the first connecting pipe 131, an end of the second elbow pipe 122 is connected to a third open end 153 of the first pipe tee 141, an end of the second connecting pipe 132 is connected to other end of the second elbow pipe 122. The third elbow pipe 123 comprises an end connected to other end of the second connecting pipe 132, and the other end connected to the top of the first treatment tank 10.

In an embodiment, the conveyer pipe group can comprise a plurality of third connecting pipes 133 and a plurality of second pipe tees 142. One of the plurality of third connecting pipes 133 is disposed in the end of the conveyer pipe group; the other of the plurality of third connecting pipes 133 is disposed in the other end of the conveyer pipe group. A fourth open end 154 and a fifth open end 155 of any one of the plurality of second pipe tees 142 are connected to the third connecting pipe 133, respectively. A sixth open end 156 of any one of the plurality of second pipe tees 142 is connected to an end of the fourth connecting pipe 134. The other end of the fourth connecting pipe 134 is connected to an end of the atomized liquid application apparatus 170.

In an embodiment, the atomizing system can comprise a discharge pipe 40, an overflow pipe 50, and a liquid collection bucket 200. An end of the discharge pipe 40 is connected to the top of the first treatment tank 10, an end of the overflow pipe 50 is inserted through the bottom end of the first treatment tank 10, and the liquid collection bucket 200 connected to other end of the overflow pipe 50.

The first treatment tank 10 can comprise a first liquid zone 91 and a first atomized liquid zone 100. The second treatment tank 20 can comprise a second liquid zone 92 and a second atomized liquid zone 110. The first liquid zone 91 can be disposed adjacent to the bottom end of the first treatment tank 10; the first atomized liquid zone 100 can be disposed adjacent to the top of the first treatment tank 10. The second liquid zone 92 can be disposed adjacent to the bottom end of the second treatment tank 20, and the second atomized liquid zone 110 can be disposed adjacent to the top of the second treatment tank 20.

The liquid supply zone 180 is in communication with the end of the first pipeline 31. The other end of the first pipeline 31 is in communication with an end of the liquid flow pipeline 60. An end of the liquid flow pipeline 60 is in communication with the first liquid zone 91, and the first liquid zone 91 is in communication with the end of the second pipeline 32 and an end of the overflow pipe 50. The other end of the overflow pipe 50 is in communication with the liquid collection bucket 200. The other end of the second pipeline 32 is in communication with the second liquid zone 92, and the gas supply zone 190 is communication with an end of the third pipeline 33. The other end of the third pipeline 33 is in communication with an end of the nozzle 80. The other end of the nozzle 80 is in communication with the second atomized liquid zone 110. The second atomized liquid zone 110 is in communication with the delivery device, the delivery device is in communication with the atomized liquid application apparatus 170 and the first atomized liquid zone 100. The first atomized liquid zone 100 is in communication with an end of the discharge pipe 40.

Each atomized liquid application apparatus 170 can comprise a humidity sensor configured to sense humidity in an interior space of the atomized liquid application apparatus 170 and display a humidity message. The humidity message comprises text, pattern, light or a combination thereof.

Figure 2:
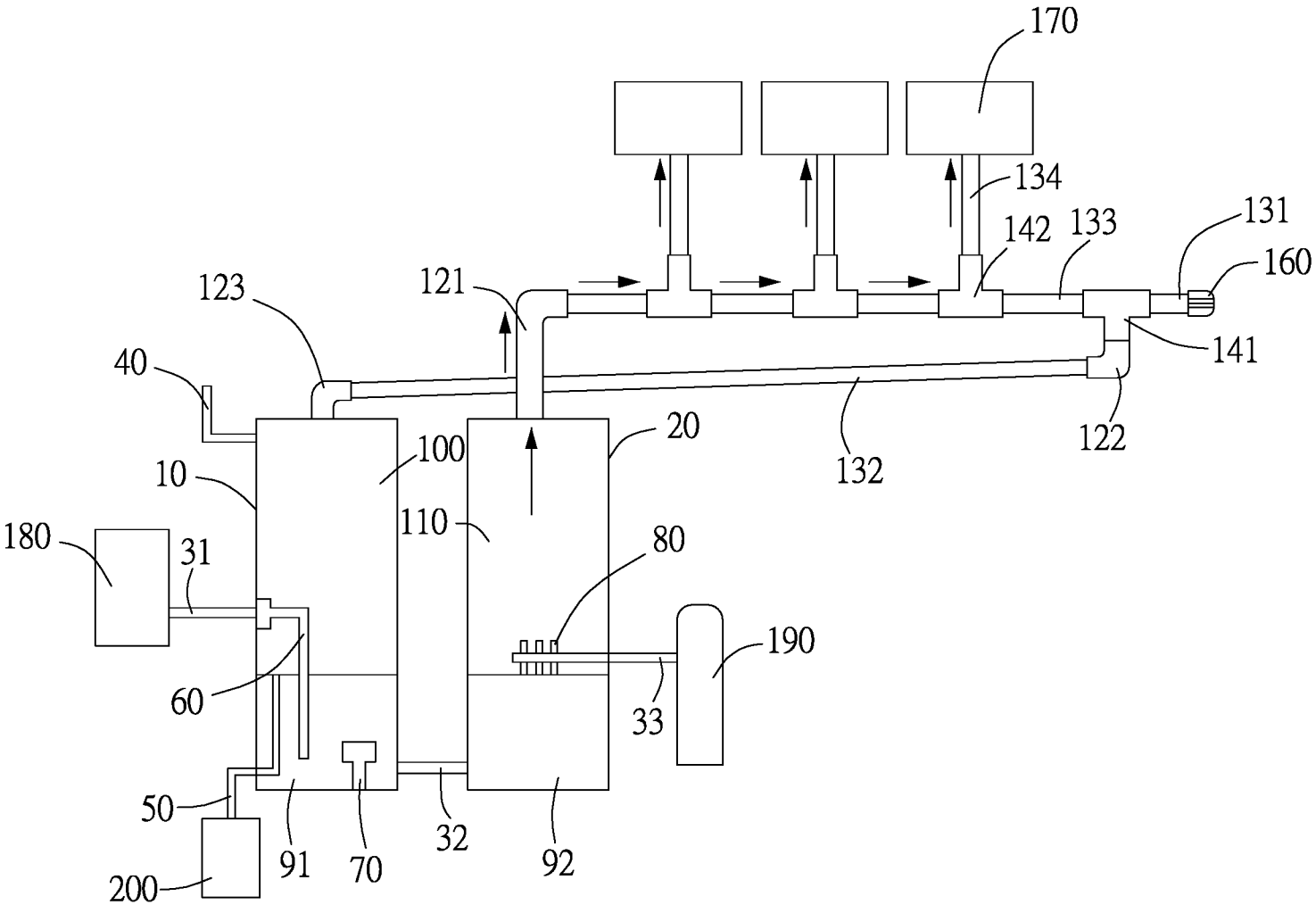
FIG. 2 is a schematic view of an atomized liquid flowing path of an atomizing system of an embodiment of the present invention.

Please refer to FIG. 2, which is a schematic view of a path flowing atomized liquid of an atomizing system of an embodiment of the present invention. As shown in FIG. 2, the liquid supplied from the liquid supply zone 180 to the liquid zone of the first treatment tank 10 can then flow to the second liquid zone 92 of the second water treatment tank through the second pipeline 32. The gas in the gas supply zone 190 can be pressurized to eject into the second treatment tank 20 through the nozzle 80. When the gas contacts the liquid in the second treatment tank 20, the second atomized liquid zone 110 of the second treatment tank 20 produces the atomized liquid, and the atomized liquid is guided, subject to the pressure provided by the gas supply zone 190, to the delivery device connected to the second treatment tank 20. When the volume of the content inside the atomized liquid application apparatus 170 changes, the atomized liquid can overflow into the atomized liquid application apparatus 170 through the fourth connecting pipe 134 of the conveyer pipe group of the delivery device. The aforementioned content is merely for exemplary illustration, and the present invention is not limited thereto.

Figure 3:
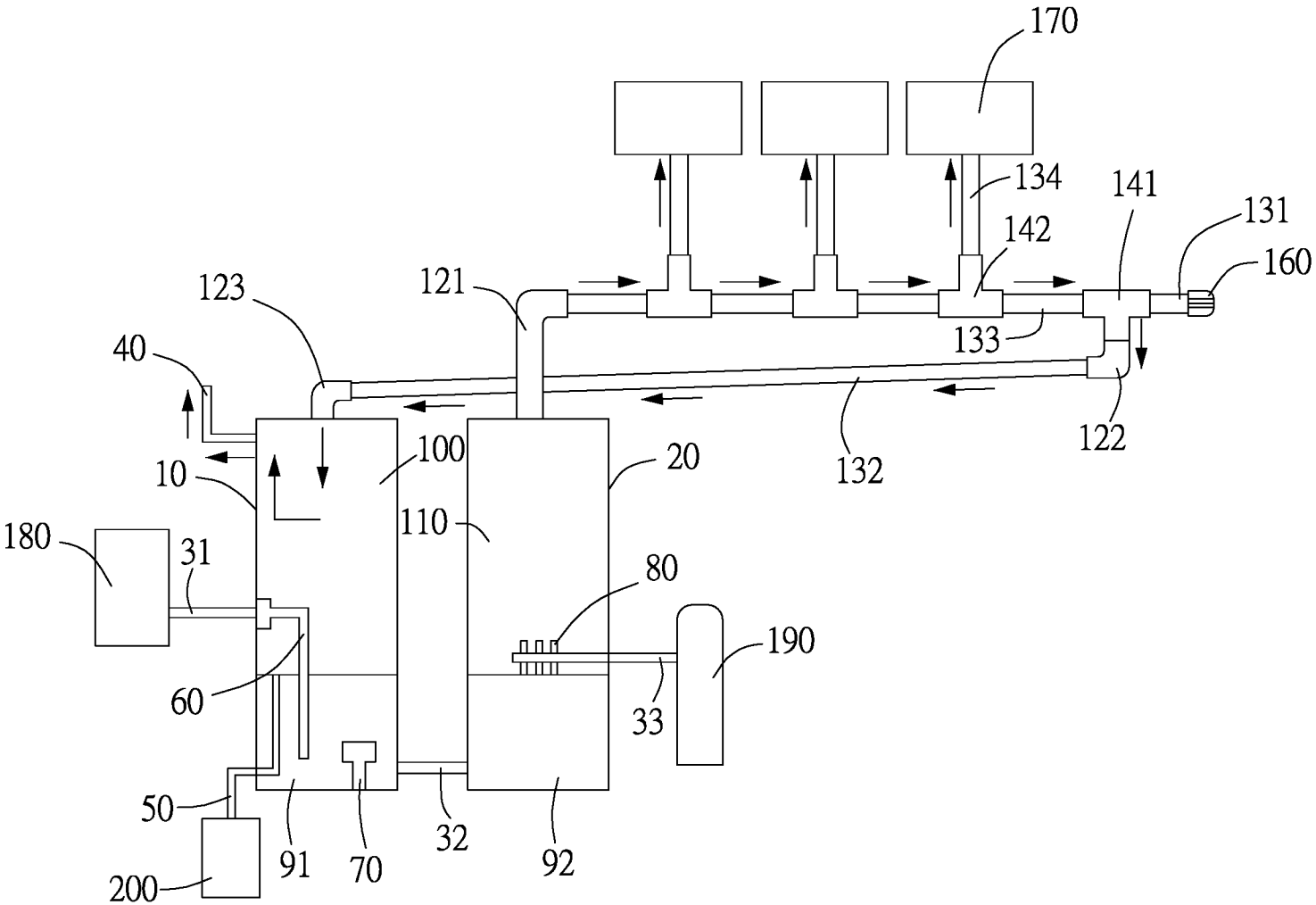
FIG. 3 is a schematic view of the path guiding the excessive atomized liquid in the delivery device of an atomizing system, according to an embodiment of the present invention.

Please refer to FIG. 3, which is a schematic view of a path guiding excess atomized liquid in the delivery device of an atomizing system of an embodiment of the present invention. As shown in FIG. 3, the atomized liquid can flow into the delivery device through the second atomized liquid zone 110, and when the atomized liquid application apparatus 170 cannot accommodate the excessive atomized liquid, the delivery device can guide excessive atomized liquid to flow into the first atomized liquid zone 100 of the first treatment tank 10. The excessive atomized liquid is then discharged from the first treatment tank 10 through the discharge pipe 40. The aforementioned content is merely for exemplary illustration, and the present invention is not limited thereto.

Figure 4:
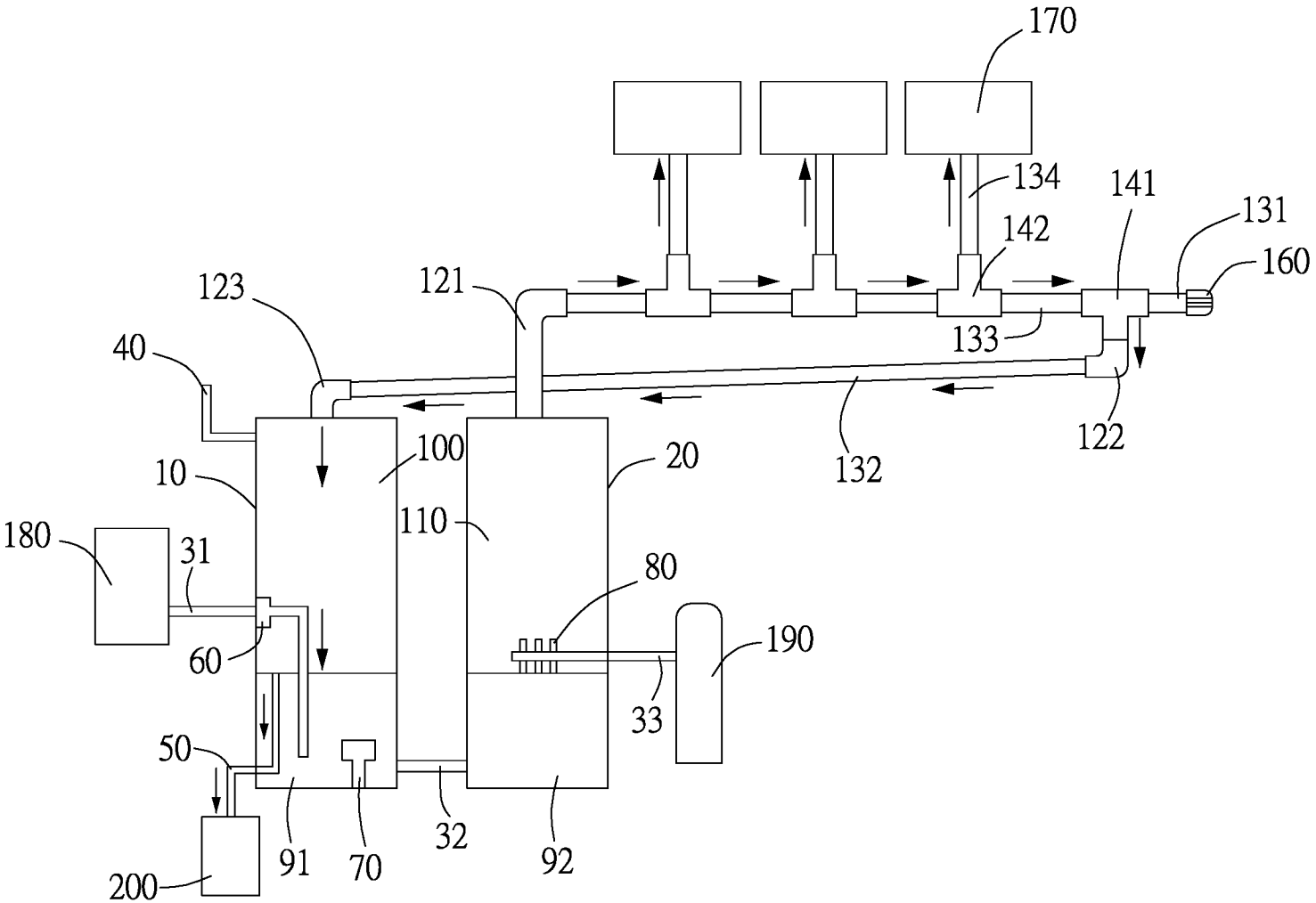
FIG. 4 is a schematic view of the path guiding the liquid, which stays in the delivery device of an atomizing system, according to an embodiment of the present invention.

Please refer to FIG. 4, which is a schematic view of the path guiding the liquid, which stays in the delivery device of an atomizing system, according to an embodiment of the present invention. As shown in FIG. 4, the atomized liquid can flow into the delivery device through the second atomized liquid zone 110. When the excessive atomized liquid forms a liquid on the pipe wall of the delivery device, the excessive liquid can reflow. The liquid goes through the reflowing structure of the delivery device and into the first liquid zone 91 of the first treatment tank 10. When the excessive liquid of the first liquid zone 91 increases the water level, the overflow pipe 50 can guide the excessive liquid to flow into the liquid collection bucket 200. Aforementioned content is merely for exemplary illustration, and the present invention is not limited thereto.

For example, after the liquid supply zone 180 is opened to flow liquid into the first liquid zone 91 of the first treatment tank 10, the liquid in the first liquid zone 91 is guided through the second pipeline 32 to flow into the second liquid zone 92 of the second treatment tank 20. The water levels of the first liquid zone 91 and the second liquid zone 92 are the same. Next, the gas supply zone 190 is opened to guide the gas to flow into the second treatment tank 20 through the nozzle 80 by using high pressure. When the gas contacts the liquid inside the second treatment tank 20, the atomized liquid is produced in the second atomized liquid zone 110. The atomized liquid is guided by the delivery device, to flow into the end of the fourth connecting pipe 134 of the conveyer pipe group. When the volume of the content inside the atomized liquid application apparatus 170 connected to an end of the fourth connecting pipe 134 changes, the atomized liquid can overflow into the atomized liquid application apparatus 170. The humidity sensor of the atomized liquid application apparatus 170 can sense the humidity inside the atomized liquid application apparatus 170 and generate a humidity message, and the humidity message can be displayed on humidity sensor by the format of text, pattern, light or a combination thereof. For example, the humidity sensor can display the humidity message by text of "the humidity inside the atomized liquid application apparatus 170 is 60%, and the user should notice the change in humidity". In an embodiment, the humidity sensor also shows the humidity message by text and light, for example, can humidity sensor can emit different light corresponding to different humidity, and display the text for supplementary illustration or suggestion for countermeasure. Aforementioned content is merely for exemplary illustration, and the present invention is not limited thereto.

For example, the atomized liquid staying in delivery device and the liquid can be guided, through the delivery device to flow into the first treatment tank 10. The atomized liquid flowing into the first atomized liquid zone 100 of the first treatment tank 10 can be discharged from the first treatment tank 10 through the discharge pipe 40, and the liquid flowing into the first liquid zone 91 of the first treatment tank 10 can stay in the first liquid zone 91 until the water level of the first liquid zone 91 is higher than the end of the overflow pipe 50. The excessive liquid can flow into the liquid collection bucket 200 through the overflow pipe 50. Aforementioned content is merely for exemplary illustration, and the present invention is not limited thereto.

Compared with the conventional atomizer device, in the atomizing system of the present invention, the atomized liquid produced in the second atomized liquid zone 110 in the second treatment tank 20 of the atomizing system can be guided. The atomized liquid is subject to the pressure supplied by the gas supply zone to flow into the delivery device, and the liquid condensed on the pipe wall of the delivery device can effectively flow into the liquid zone of the first treatment tank 10 through the pipes of the delivery device. This prevents the liquid from entering the atomized liquid application apparatus 170 to affect the content inside the atomizer device. Furthermore, the excessive atomized liquid can be guided to flow into the first atomized liquid zone 100 of the first treatment tank 10. When excessive atomized liquid or the liquid flows into the first treatment tank 10 through the delivery device, the excessive atomized liquid can be discharged from the first treatment tank 10 through the discharge pipe 40 of the first treatment tank 10. This allows the operation of flowing liquid into the first treatment tank 10 not to be affected. When the excessive liquid reflows into the liquid zone of the first treatment tank 10 to cause excessively-high water level, the excessive liquid can be guided by the overflow pipe 50 to flow into the liquid collection bucket 200. As a result, the atomizing process of producing atomized liquid in the second treatment tank 20 can be prevented from being affected by the atomized liquid or liquid reflowing from the delivery device, thereby maintaining stability of the atomizing process.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An atomizing system, connected to a liquid supply zone and a gas supply zone and comprising:

a first pipeline comprising an end connected to the liquid supply zone;

a first treatment tank connected to other end of the first pipeline;

a second pipeline comprising an end connected to a bottom end of the first treatment tank;

a second treatment tank comprising a bottom end connected to other end of the second pipeline;

a third pipeline comprising an end connected to the gas supply zone, with the other end inserted through the second treatment tank;

a plurality of nozzles, wherein each of the plurality of nozzles comprises an end connected to the other end of the third pipeline;

a liquid flow pipeline disposed inside the first treatment tank, and comprising an end connected to the other end of the first pipeline; and a water level sensor disposed inside the first treatment tank, and comprising an end connected to the bottom end of the first treatment tank;

wherein liquid supplied from the liquid supply zone is flowed into the second treatment tank through the second pipeline, gas supplied from the gas supply zone is flowed into the second treatment tank through the nozzle, and the liquid contacts the gas in the second treatment tank to produce atomized liquid.

2. The atomizing system of claim 1, further comprising a delivery device, wherein the delivery device comprises a first elbow pipe, a conveyer pipe group, a first pipe tee, a first connecting pipe, a second elbow pipe, a pipe cap, a second connecting pipe, and a third elbow pipe, and an end of the first elbow pipe is connected to a top of the second treatment tank, an end of the conveyer pipe group is connected to other end of the first elbow pipe, a first open end of the first pipe tee is connected to other end of the conveyer pipe group, a second open end of the first pipe tee is connected to an end of the first connecting pipe, and the pipe cap is connected to other end of the first connecting pipe, an end of the second elbow pipe is connected to a third open end of the first pipe tee, an end of the second connecting pipe is connected to other end of the second elbow pipe, an end of the third elbow pipe is connected to other end of the second connecting pipe, and other end of the third elbow pipe is connected to the top of the first treatment tank.

3. The atomizing system of claim 2, wherein the conveyer pipe group comprises a plurality of third connecting pipes and a plurality of second pipe tees, one of the plurality of third connecting pipes is disposed in an end of the conveyer pipe group, the other of the plurality of third connecting pipes is disposed in other end of the conveyer pipe group, and a fourth open end and a fifth open end of any one of the plurality of second pipe tees are connected to the third connecting pipe, respectively, and a sixth open end of any one of the plurality of second pipe tees is connected to an end of a fourth connecting pipe, and other ends of the plurality of fourth connecting pipes are connected to ends of a plurality of atomized liquid application apparatuses.

4. The atomizing system of claim 3, further comprising a discharge pipe, an overflow pipe, and a liquid collection bucket, wherein an end of the discharge pipe is connected to the top of the first treatment tank, an end of the overflow pipe is inserted through the bottom end of the first treatment tank, and the liquid collection bucket is connected to other end of the overflow pipe.

5. The atomizing system of claim 4, wherein the first treatment tank comprises a first liquid zone and a first atomized liquid zone, and the second treatment tank comprises a second liquid zone and a second atomized liquid zone, the first liquid zone is disposed adjacent to the bottom end of the first treatment tank, the first atomized liquid zone is disposed adjacent to the top of the first treatment tank, the second liquid zone is disposed adjacent to the bottom end of the second treatment tank, and the second atomized liquid zone is disposed adjacent to the top of the second treatment tank.

6. The atomizing system of claim 5, wherein the liquid supply zone is in communication with the end of the first pipeline, the other end of the first pipeline is in communication with the end of the liquid flow pipeline, the end of the liquid flow pipeline is in communication with the first liquid zone, the first liquid zone is in communication with the end of the second pipeline and the end of the overflow pipe, the other end of the overflow pipe is in communication with the liquid collection bucket, the other end of the second pipeline is in communication with the second liquid zone, the gas supply zone is communication with the end of the third pipeline, the other end of the third pipeline is in communication with the ends of the plurality of nozzles, the other ends of the plurality of nozzles are in communication with the second atomized liquid zone, the second atomized liquid zone is in communication with the delivery device, the delivery device is in communication with the plurality of atomized liquid application apparatuses and the first atomized liquid zone, and the first atomized liquid zone is in communication with the end of the discharge pipe.

7. The atomizing system of claim 3, wherein each of the plurality of atomized liquid application apparatuses comprises a humidity sensor configured to sense humidity in an interior space thereof and display a humidity message.

8. The atomizing system of claim 7, wherein the humidity message comprises a text, a pattern, a light or a combination thereof.

* * * * *